US009850914B2

(12) United States Patent
Dreesen

(10) Patent No.: US 9,850,914 B2
(45) Date of Patent: Dec. 26, 2017

(54) VENTILATION DEVICE AND VEHICLE WITH A VENTILATION DEVICE

(71) Applicant: Brose Fahrzeugteile GmbH & Co. Kommanditgesellschaft, Wuerzburg, Wuerzburg (DE)

(72) Inventor: Thomas Dreesen, Oldenburg (DE)

(73) Assignee: Brose Fahrzeugteile GmbH & Co. Kommandtigesellschaft, Wuerzburg, Wuerzburg (DE)

( * ) Notice: Subject to any disclaimer, the term of this patent is extended or adjusted under 35 U.S.C. 154(b) by 262 days.

(21) Appl. No.: 14/726,757

(22) Filed: Jun. 1, 2015

(65) Prior Publication Data

US 2015/0260200 A1 Sep. 17, 2015

Related U.S. Application Data

(63) Continuation of application No. PCT/EP2013/003443, filed on Nov. 15, 2013.

(30) Foreign Application Priority Data

Nov. 30, 2012 (DE) ..... 10 2012 023 454

(51) Int. Cl.
*F04D 29/64* (2006.01)
*F04D 29/16* (2006.01)
(Continued)

(52) U.S. Cl.
CPC ..... *F04D 29/646* (2013.01); *F01P 5/06* (2013.01); *F04D 19/002* (2013.01);
(Continued)

(58) Field of Classification Search
CPC .... F04D 29/646; F04D 19/002; F04D 29/325; F04D 29/326; F04D 29/522;
(Continued)

(56) References Cited

U.S. PATENT DOCUMENTS 5,297,931 A 3/1994 Yapp et al.
5,423,660 A 6/1995 Sortor
(Continued)

FOREIGN PATENT DOCUMENTS

CN 1222887 A 7/1999
DE 8300096 U1 6/1983
(Continued)

*Primary Examiner* — Christopher Verdier
(74) *Attorney, Agent, or Firm* — Laurence A. Greenberg; Werner H. Stemer; Ralph E. Locher

(57) ABSTRACT

A ventilation device has a holder, in particular a ventilation frame, with a substantially circular continuous opening for receiving a ventilation wheel rotating about the central axis, thereof. The opening is bordered by an edge face running substantially cylinder-symmetrically about the central axis. As the edge face in two separate, diametrically opposed peripheral sections the radius is at least partly enlarged in comparison to the cylinder-symmetrical form in the remaining peripheral sections, and/or a circular projection of she edge face, which projection projects radially inwards, is axially offset away from a space provided for the ventilation wheel. Because of she corresponding shaping of the edge face of the opening, contact and/or development of noise between the ventilation wheel and the edge of the opening is prevented in the ventilation frame in the event of a yawing of the ventilation wheel.

9 Claims, 7 Drawing Sheets

(51) Int. Cl.

| | |
|---|---|
| ***F04D 29/54*** | (2006.01) |
| ***F04D 29/32*** | (2006.01) |
| ***F01P 5/06*** | (2006.01) |
| ***F04D 29/52*** | (2006.01) |
| ***F04D 19/00*** | (2006.01) |

(52) U.S. Cl.
CPC ..... *F04D 29/164* (2013.01); *F04D 29/325* (2013.01); *F04D 29/326* (2013.01); *F04D 29/522* (2013.01); *F04D 29/526* (2013.01); *F04D 29/545* (2013.01); *F04D 29/547* (2013.01); *F01P 2070/50* (2013.01)

(58) Field of Classification Search
CPC .... F04D 29/526; F04D 29/164; F04D 29/545; F04D 29/547; F01P 2070/50; F01P 5/02; F01P 5/06
USPC ..... 415/173.1, 173.5, 173.6, 220, 222, 223, 415/208.1, 211.2
See application file for complete search history.

(56) References Cited

U.S. PATENT DOCUMENTS

| | | | | |
|---|---|---|---|---|
| 5,489,186 | A | 2/1996 | Yapp et al. | |
| 6,099,247 | A | 8/2000 | Nishio | |
| 6,726,441 | B2 | 4/2004 | Sumser et al. | |
| 7,042,121 | B2 | 5/2006 | De Filippis et al. | |
| 7,575,412 | B2 | 8/2009 | Seitz | |
| 2009/0226312 | A1 | 9/2009 | Liu et al. | |
| 2010/0229810 | A1* | 9/2010 | Blass ..... | F01P 5/06 123/41.57 |

FOREIGN PATENT DOCUMENTS

| | | | |
|---|---|---|---|
| DE | 9016496 | U1 | 3/1991 |
| DE | 19638518 | A1 | 4/1998 |
| DE | 19857926 | A1 | 7/1999 |
| DE | 20003276 | U1 | 5/2000 |
| DE | 10105456 | A1 | 8/2002 |
| DE | 69430488 | T2 | 12/2002 |
| DE | 10330084 | A1 | 3/2004 |
| DE | 202009009560 | U1 | 9/2009 |
| DE | 102011009779 | A1 | 8/2012 |
| EP | 1621773 | A1 | 2/2006 |
| JP | S6367620 | U | 5/1988 |
| JP | 3390989 | B2 | 3/2003 |
| WO | 9506822 | A1 | 3/1995 |

* cited by examiner

VENTILATION DEVICE AND VEHICLE WITH A VENTILATION DEVICE

CROSS-REFERENCE TO RELATED APPLICATION

This is a continuation application, under 35 U.S.C. §120, of copending international application No. PCT/EP2013/003443, filed Nov. 15, 2013, which designated the United States; this application also claims the priority, under 35 U.S.C. §119, of German patent application No. DE 10 2012 023 454.6, filed Nov. 30, 2012; the prior applications are herewith incorporated by reference in their entirety.

BACKGROUND OF THE INVENTION

Field of the Invention

The invention lies within the field of mechanical engineering and relates to a ventilation device and a vehicle with a ventilation device, wherein a ventilation device of this kind can be used to increase the air throughput for cooling purposes, for example.

Particularly in the case of motor vehicles, it is customary for a combustion engine to be provided in the drive train, the combustion engine requiring cooling. Since heat radiation and convection is not sufficient for this purpose, a cooling process of this kind is usually supported by a cooling airflow which, on the one hand, can be produced by the airflow when the vehicle is moving which, on the other hand, is usually also supported by a ventilation device. The interposition of a cooling device in the form of a fluid cooling circuit is viable in this case, wherein a heat exchanger (cooler) is exposed to the airflow while traveling and the airflow from a ventilation device.

A ventilation device of this kind usually has a drivable fan wheel which has a conveying member for air in the form of a screw, a blade wheel or a propeller. A fan wheel of this kind is mounted in such a manner that it is held within a continuous opening in a fan frame or, generally, a holder surrounding the opening in a radial direction. The level of efficiency of the ventilation device is particularly high when the gap between the fan wheel and the periphery of the opening in the fan frame is as small as possible.

On the other hand, when there are small gaps, a problem that arises among other things and alongside the risks caused by tolerances, material and poor road conditions, is that a yawing moment, i.e. with the spinning forces that occur when the fan wheel is rotating quickly, a "pitching" of the fan wheel takes place, i.e. an inclination of the rotating fan wheel about a horizontal axis running transversely to the direction of travel. This means that when there is a small fan wheel gap, the fan wheel rubs against the periphery of the opening in the fan frame which, on the one hand, slows down the fan wheel and, on the other, causes unpleasant noises. It must also be taken into account that contact of this kind can result in damage to or a breakage of the fan wheel.

The use of an electrically drivable fan in a vehicle, in order to increase the airflow and run a cooling device in the vehicle, is known in principle from published, European patent application EP 1 621 773 A1, for example. In this case, a cooler network is disposed in the airflow produced in this way, which cooler network has pipes running through it through which a coolant flows. By means of the coolant, a heat exchange is produced with the unit being cooled. The fan is electrically drivable in this case.

SUMMARY OF THE INVENTION

Against the background of the prior art, the problem addressed by the present invention is that of creating a ventilation device of the kind referred to above which allows the smallest possible gap between the fan wheel and the periphery of the opening in the fan frame, even when the ventilation device is tilted when a vehicle fitted with the ventilation device is cornering, for example.

This problem is solved according to the invention by the features of the main claim. Consequently, a ventilation device with a holder, in particular a fan frame, is provided, which fan frame exhibits a substantially circular continuous opening for receiving a fan wheel rotating in the opening about the center axis thereof, wherein the opening is bordered by a peripheral face running substantially cylinder-symmetrically about the center axis. In addition, it is provided that in the case of the peripheral face in two separate circumferential portions diametrically opposite one another the radius is at least partly enlarged in comparison with the cylinder-symmetrical form in the remaining circumferential portions and/or a circumferential projection from the peripheral face projecting radially inwards is axially offset from the space provided for the fan wheel. The peripheral face in this case may exhibit different forms in the longitudinal section which are described in greater detail by way of example below; for instance, it may exhibit a circumferential projection running at least partly radially in the longitudinal section in the form of a step, chamfer or lip.

Through the corresponding radial enlargement/widening of the peripheral face of the opening in two circumferential portions lying opposite one another during a rotation of a fan wheel provided in the opening, a tilting of the rotating fan wheel or else the ventilation device is made possible about an axis lying substantially parallel to the connecting axis between the two separate circumferential portions, the peripheral face whereof is enlarged relative to the radius. A corresponding "pitching movement" resulting from the yawing moment on the fan wheel is thereby made possible, in that the gap in the corresponding circumferential portions is slightly larger. In this case, the circumference of the fan wheel still does not therefore make contact either with the periphery of the opening or with a radially inwardly pointing projection, despite the pitching movement.

Depending on the thickness of the fan frame in which the continuous opening is provided for the fan wheel, the cylinder-symmetrical peripheral face extends over a smaller or greater axial length in the direction of the center axis of the opening. It may be advantageously provided in this case that the radius of the peripheral face in the two separate circumferential portions is enlarged at least on a partial face of the part of the peripheral face which extends in the axial direction or in the entire part of the peripheral face which extends in the axial direction, in comparison with the cylinder-symmetrical form in the remaining circumferential portions.

The total radius of the peripheral face in the region of the separate circumferential portions lying opposite one another need not therefore be extended radially; instead, it is often sufficient for the peripheral face to be extended over only part of its axial length compared with the radius in the remaining circumferential portions. The transition between the radially extended axial regions of the peripheral face in the separate circumferential portions and the non-extended axial part of the peripheral face may be configured in step form, for example, or by a conical transitional region.

It may also be provided that the peripheral face in the longitudinal section forms a profile with a variable radius relative to the axial length and that the radius of the peripheral face is at least partly enlarged in two separate circumferential portions of a cross section diametrically opposite one another in comparison with the radius present in the remaining circumferential portions of the same cross section.

In the longitudinal section, i.e. in a section parallel to the center axis of the opening, the peripheral face, as already mentioned above, need not necessarily have a cylindrical contour, but it may change in an axial direction relative to the radius, for example in the form of a conical portion or one or a plurality of steps or in the form of a circumferential, channel-shaped groove. The corresponding profile may be provided circumferentially over the entire circumferential region of the opening, wherein individual axial portions of the peripheral face are extended in relation to their radius in the two separate circumferential portions lying opposite one another or, in the case of an axial portion with a circumferential groove, for example, are moved axially in respect of the remaining circumferential regions. For example, by a circumferential step, a kind of labyrinth seal can be provided in the opening between the fan wheel and the periphery of the opening, wherein the fan wheel itself runs in a region of the opening with the greater radius, while a radially inwardly projecting step is provided adjacent to the fan wheel in the peripheral face of the opening. The contour of the fan wheel may likewise form a circumferential step which may be formed to match a step provided in the peripheral face. This means that the radial/axial gap between the fan wheel and the peripheral face is lengthened and the seal improved. It may be advantageous in this case for the peripheral face to have at least one step running in a radial direction in respect of the center axis in the longitudinal section and for the radius of the peripheral face to be at least partly enlarged in at least one cross-sectional face on at least one axial side of the step in two separate circumferential portions diametrically opposite one another in comparison with the radius present in the remaining circumferential portions of the same cross-sectional face. A radially running step in this case should not only be understood to mean a step with a side running perpendicularly to the axial direction, but also a step with a side running obliquely to the axial direction.

The embodiment of the invention in this case may provide that the radially inwardly projecting step of the peripheral face is disposed upstream or also downstream of the fan wheel in the course of the airflow.

The contour covered by the fan wheel during its rotation may exhibit a step which may in particular be configured in a manner substantially matching the step in the peripheral face. This means that a labyrinth-like gap is created between the peripheral face and the fan wheel.

Moreover, it may be advantageous for the peripheral face in the longitudinal section to have a step or lip running in a radial direction in respect of the center axis, which step or lip forms a seal surface for a radial outer region of the fan wheel, characterized in that the step or lip is offset in an axial direction in two separate circumferential portions diametrically opposite one another in comparison with the remaining circumferential portions, in order to increase the space for receiving the fan wheel in this region.

There is therefore an axial spring-back of the seal surface in the region of the peripheral face of the opening in respect of the contour of the fan wheel in the two separate circumferential portions lying opposite one another. In this way, the seal in the separate circumferential portions is made slightly worse by a greater gap between the fan and the peripheral face of the opening, but smaller gap dimensions are made possible overall in the remaining circumferential portions of the fan wheel without there being any fear of the fan rubbing against the periphery of the opening. If there is a pitching movement of the fan wheel when a yawing moment occurs, the additional space is used by the fan wheel. The gap between the fan and the peripheral face, viewed in the longitudinal section, may in this case run in an axial and radial direction combined (L-shaped gap) or even exhibit different or further turns.

A further advantageous embodiment of the invention provides that the axial offset of the step or lip in the separate circumferential portions in the circumferential direction is variable in steps or continuously and reaches a maximum in each case in the center of the separate circumferential portions.

This configuration allows a gradual transition in the deviation of the cylinder-symmetrical configuration of the periphery of the opening from the two separate, radially enlarged circumferential portions from the remaining circumferential portions of the periphery of the opening configured in a cylinder-symmetrical manner without radial enlargement.

This also takes account of the fact that a "pitching movement" of the fan wheel naturally exhibits the greatest amplitude at the two points on the circumference of the fan wheel which are at the greatest distance from the "pitching axis", in other words from the axis about which the pitching movement of the fan wheel takes place as a result of the yawing moment.

The amplitude of the pitching movement constantly decreases in the circumferential direction with the distance from these points.

In addition, the invention may advantageously be configured in that the peripheral face is concavely curved at least in the two separate circumferential portions diametrically opposite one another, viewed in the longitudinal section. This produces a particularly close adaptation of the fan wheel in the region of the separate circumferential portions during a pitching movement to the corresponding contour of the peripheral face which may be concave in design, since the pitching movement about a pitching axis constitutes a circular tilting movement of the fan wheel. This means that in this region the gap between the contour of the fan wheel and the peripheral surface of the opening is minimized.

For this purpose, it may be particularly provided that the circumferential portions of the peripheral face which are of concave design in the longitudinal section form part of a spherical face which has its spherical center point within the continuous opening, in particular, on the center axis thereof. The center point of the sphere may also be spaced apart on the center axis of the opening.

Apart from on a ventilation device with a fan frame which, on account of the forming of the peripheral face of the opening for a fan wheel described above, allows the installation of a fan wheel adapted thereto with a minimal axial gap, the invention also relates to a ventilation device with a fan wheel fitted therein which satisfies the corresponding conditions. The invention therefore relates to a ventilation device with a fan frame which has a substantially circular continuous opening with a fan wheel rotating in the opening about the center axis thereof, wherein the opening is delimited by a peripheral face revolving in a substantially cylinder-symmetrical manner about the center axis and wherein a gap is formed between the circumferential contour of the fan wheel and the peripheral face, wherein the continuous opening is radially extended in two separate circumferential portions diametrically opposite one another in comparison with the cylinder-symmetrical form in the remaining circumferential portions.

The invention further relates to a vehicle with a ventilation device according to the invention with a fan wheel that can be driven rotatably about a center axis in a continuous opening. Wherein the installation position of the ventilation device in the vehicle is such that the center axis is substantially oriented in the straightforward driving direction of the vehicle, and the continuous opening is radially extended in a circumferential portion arranged in its uppermost region and a second in its lowermost region in comparison with the cylinder-symmetrical form in the remaining circumferential portions.

Through the corresponding configuration of the ventilation device according to the invention, optimized cooling of a vehicle assembly is made possible without there being any fear of the fan wheel rubbing against the peripheral face of the opening of the fan frame when the vehicle is cornering.

Other features which are considered as characteristic for the invention are set forth in the appended claims.

Although the invention is illustrated and described herein as embodied in a ventilation device and a vehicle with the ventilation device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
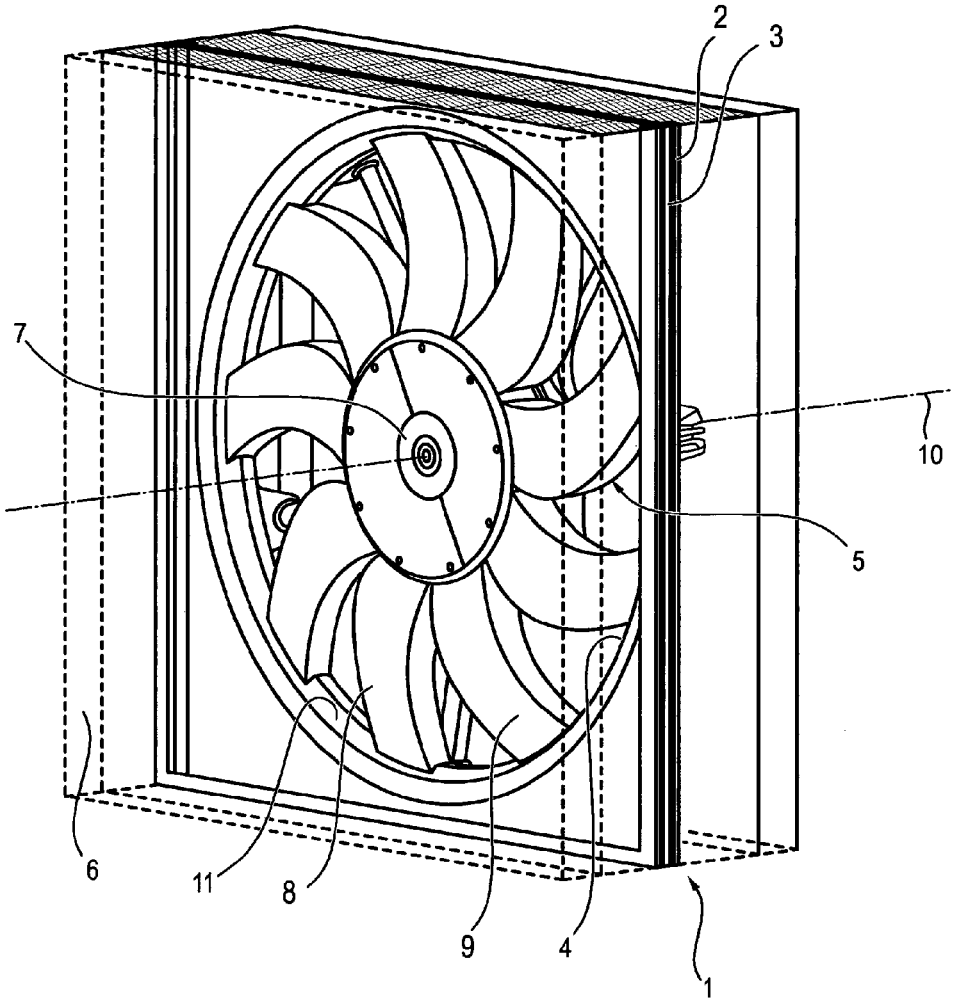
FIG. 1 is a diagrammatic, perspective view of a ventilation device with a fan frame and a fan wheel.

Referring now to the figures of the drawings in detail and first, particularly to FIG. 1 thereof, there is shown schematically part of a so-called cooler housing 1 with a circumferential frame 2 into which a fan frame 3 is inserted. The fan frame 3 may be configured as a plate, for example, which has a substantially circular opening 4 for receiving a fan wheel 5. In the cooler housing 1, a cooler may be upstream or downstream of the fan frame 3 and the fan wheel 5 in the course of the airflow, which cooler is only depicted schematically as a housing 6 in FIG. 1 using dotted lines.

Moreover, still further heat-exchanger devices can also be provided in the airflow of the fan wheel 5, such as a capacitor network, for example.

The fan wheel 5 has a hub 7 which is connected to a shaft which is not shown and which is connected to an electric motor and can be driven by the motor. The electric motor and also the shaft and therefore also the fan wheel 5 are fixed within the cooler housing 1, for example by webs which are fixedly connected to the frame 2. This means that the fan wheel 5 is held in such a manner that it is able to rotate in the continuous opening 4.

The fan wheel 5 has a plurality of, in the example shown nine, conveying blades 8, 9 which convey air in an axial direction in respect of the center axis 10 of the opening 4 during rotation of the fan wheel 5. The center axis 10 also represents the rotational axis of the fan wheel and the center axis of the shaft which is not shown.

The individual conveying blades 8, 9 are fixedly connected to one another by a circumferential fan wheel ring 11 radially on the outside in respect of the center axis 10. Between the fan wheel ring 11 and the periphery of the opening 4, a gap is provided running substantially in an axial direction 10, which gap ensures that the fan wheel or the fan wheel ring 11 does not rub against the fan frame 3 and that, on the other hand, the intermediate space between the fan wheel 5 and the fan frame 3 is as small as possible, in order to allow good performance through an efficient conveying of the airflow by the fan wheel 5. The wider the axial gap, the sooner the pressure differential produced by the fan wheel 5 between the intake and output side of the ventilation device on the fan wheel radially past on the outside can be balanced again, without the conveyed air being able to be supplied for its own benefit.

Figure 2:
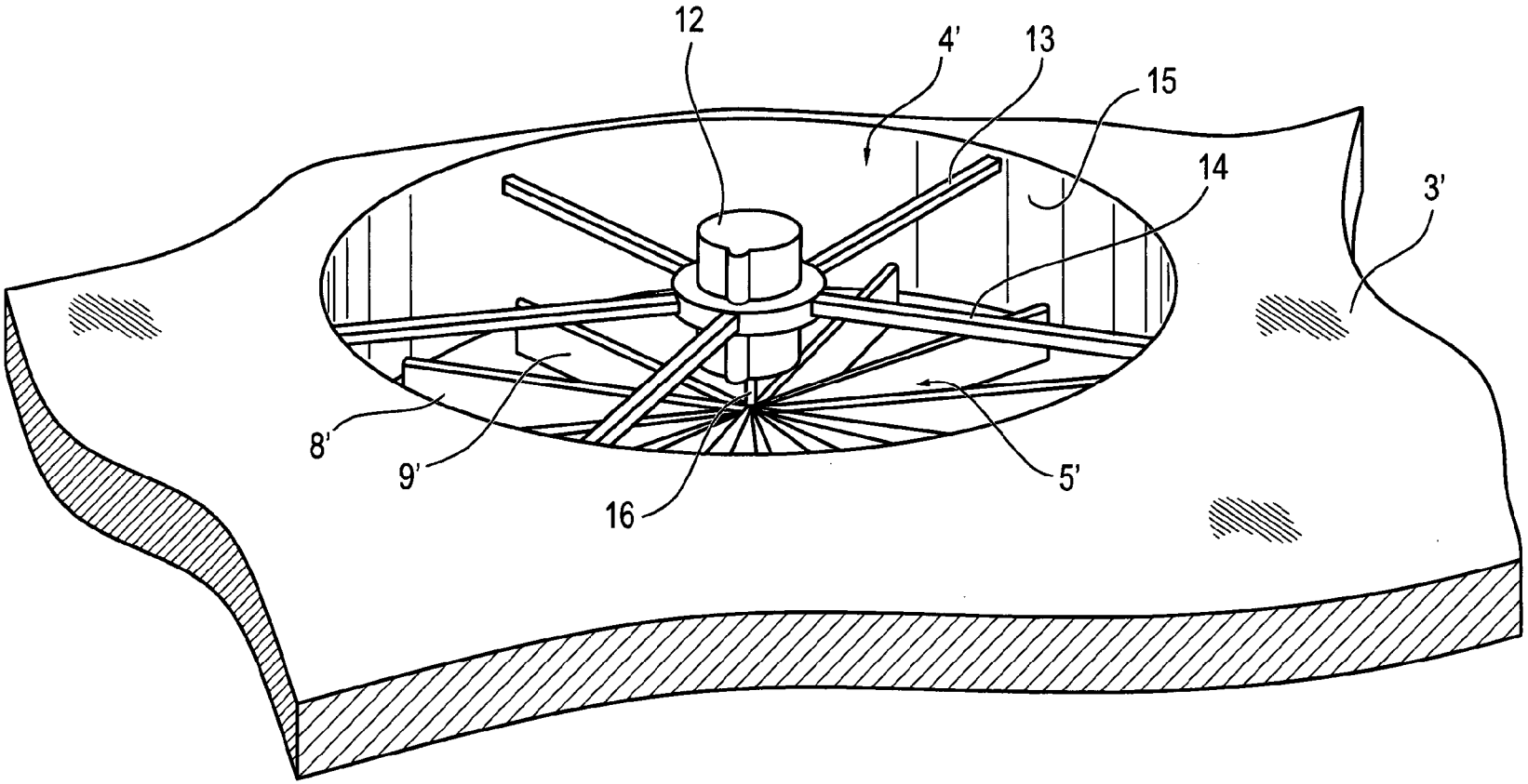
FIG. 2 is a perspective view of a further ventilation device with a fan frame and a fan wheel.

FIG. 2 shows as a three-dimensional view a ventilation device within a further frame 3', wherein a motor 12 in the form of an electric motor is depicted there, which motor is secured to a peripheral face 15 of the fan frame 3' by webs 13, 14. A shaft 16 is connected to the electric motor 12, which shaft is fixed in the hub of a fan wheel 5' and drives the fan wheel 5'. In the embodiment in FIG. 2, conveying blades 8', 9' are provided which are not connected to one another at their outer circumference by a fan wheel ring 11. The axial gap between the fan wheel 5' and the peripheral face 15 of the opening in the fan frame 3' is determined in this case by the contour of the conveying blades interspersed/covered during rotation and the shape of the opening or of the peripheral face 15.

Figure 3:
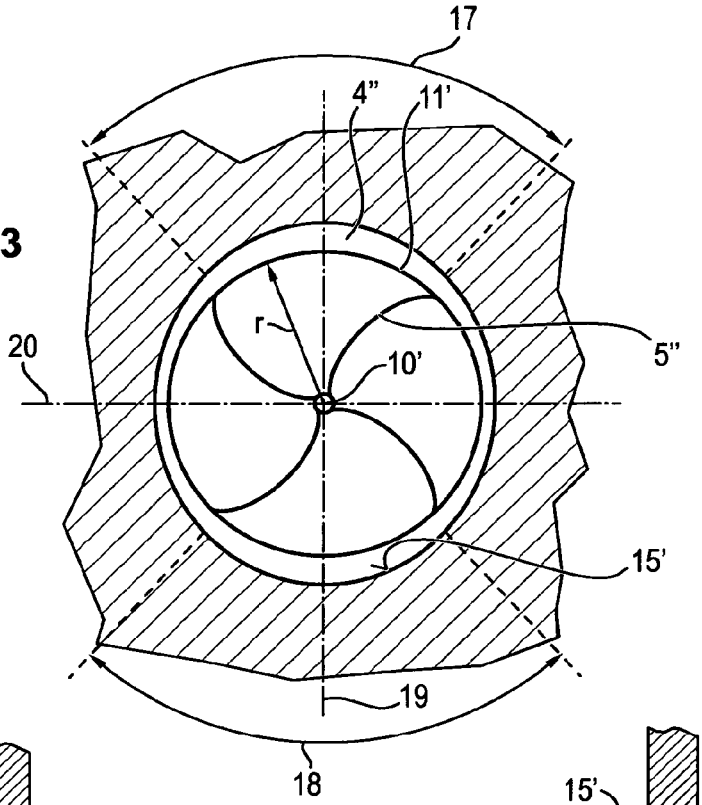
FIG. 3 is a front view of a detail of a fan frame with a continuous opening and a fan wheel.
Figure 4:
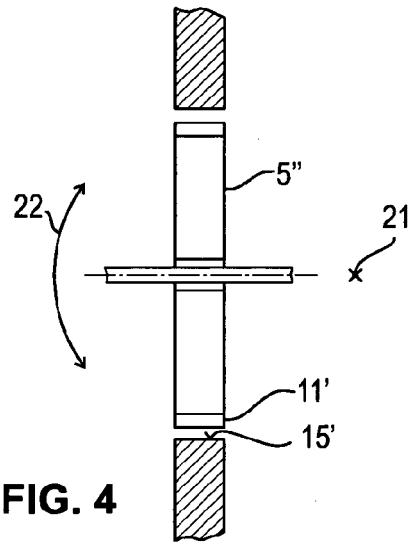
FIG. 4 is a longitudinal sectional view through the assembly from FIG. 3.
Figure 5:
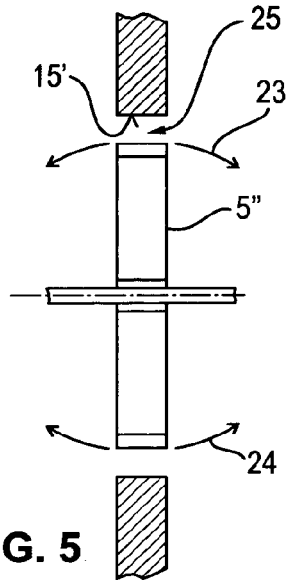
FIG. 5 is a longitudinal sectional view through the assembly from FIG. 3.

To explain the invention in greater detail, the problem is initially described in greater detail with the help of FIGS. 3, 4 and 5.

FIG. 3 shows schematically as a front view a fan wheel 5" with a fan wheel ring 11' which is mounted in an opening 4" rotatingly about the center axis 10'. The opening 4" is formed within a fan frame indicated by hatching.

It can be seen from FIG. 3 that the opening 4" is not perfectly circular in form, but that it is enlarged in the separate circumferential portions 17, 18 which are indicated by double arrows between dotted lines extending radially in each case, the radius r of the opening or else of the peripheral face of the opening 4" being enlarged in comparison with the other circumferential portions.

This measure according to the invention takes account of the fact that when the fan wheel 5" or the entire ventilation device is tilted about the axis 19 or an axis parallel thereto, a pitching movement of the fan wheel 5" from the drawing plane or into the drawing plane takes place about the axis 20 lying in the drawing plane.

This is made particularly clear by FIGS. 4 and 5. A longitudinal section of the ventilation device from FIG. 3 along the axis 20 is depicted in FIG. 4.

A relatively narrow axial gap can be seen in each case on either side of the fan wheel 5" between the fan wheel ring 11' and the periphery 15' of the opening 4". It is assumed that the ventilation device is tilted when the fan wheel 5" is rotating quickly about an axis 21 standing perpendicular to the drawing plane in FIG. 4, as is indicated by the double arrow 22. The spinning moments when the fan wheel 5" is rotating then produce a pitching movement perpendicular to the plane of the tilting movement, as is shown in FIG. 5, which depicts a section along the axis 19 in FIG. 3, indicated by the double arrows 23, 24. When there are tilting movements of the ventilation device, as commonly occur during cornering when used in motor vehicles, for example, a pitching movement in the order of magnitude of a tilt by a few degrees takes place. This means that the axial gap 25, as indicated in FIG. 5, is advantageously enlarged radially in respect of the remaining circumferential regions in the two regions in which the greatest amplitude of the pitching movement occurs, in order to avoid contact between the fan wheel 5" and the periphery of the opening 4". This is achieved in that in this region, as indicated in FIG. 3, the opening 4" is radially enlarged by a radial widening of the peripheral face 15' of the opening 4".

Figure 6:
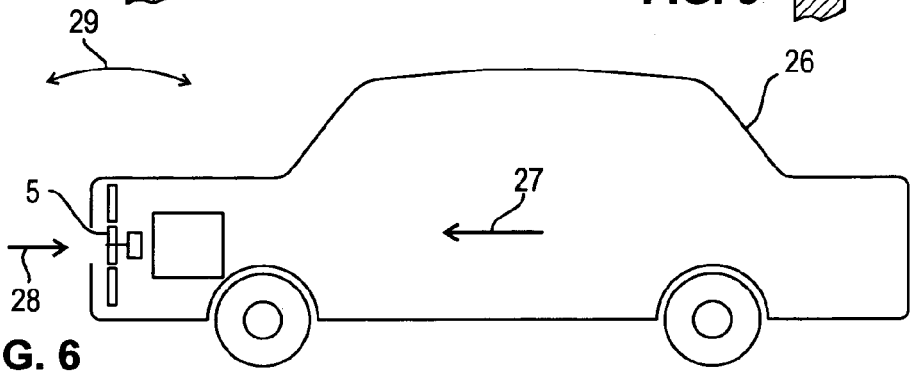
FIG. 6 is an illustration showing an installation position of the ventilation device according to the invention in a motor vehicle.

The installation position of a ventilation device according to the invention in a motor vehicle 26 is shown schematically in FIG. 6. All that is specifically labeled is the fan wheel 5 and also the travelling direction of the motor vehicle indicated by the arrow 27 and the direction of the headwind by the arrow 28. The direction of the pitching movement of the fan wheel 5 when the motor vehicle is cornering is indicated by the tilting double arrow 29.

This means that when it is fitted into a motor vehicle, the separate circumferential portions 17, 18 in which the opening of the fan wheel is to be extended have to be provided in the upper and lower region of the opening.

In principle, the separate circumferential portions 17, 18 in which the opening is radially extended and the axial gap enlarged can each take up at least ten degrees, in particular at least twenty degrees, further advantageously particularly at least thirty degrees, of the total circumference of the fan wheel ring or of the periphery of the opening. It is moreover advantageous if the separate circumferential portions 17, 18 combined do not take up more than 180 degrees of the total circumference. Both separate circumference portions are advantageously roughly the same, they should advantageously differ by no more than 50% in relation to the circumference taken up. The radius differences between the peripheral faces of the opening in the separate circumferential portions and in the remaining circumferential portions should advantageously be less than 5%, further advantageously less than 3%.

Figure 7:
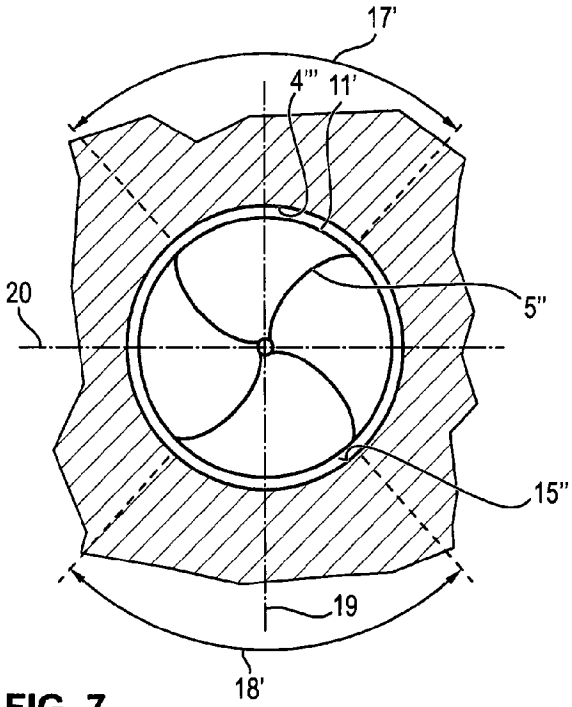
FIG. 7 is a front view of a further ventilation device with a fan wheel.

FIG. 7 shows the front view of an embodiment of the invention in which the radial extension of the opening 4'" cannot immediately be seen in the separate circumferential portions from the front side.

A fan wheel 5" is likewise provided for in this case with a fan wheel ring 11' which forms an axial gap along with the peripheral face 15" of the opening 4'". The separate circumferential portions are labeled 17', 18' and lie symmetrically opposite one another.

Figure 8:
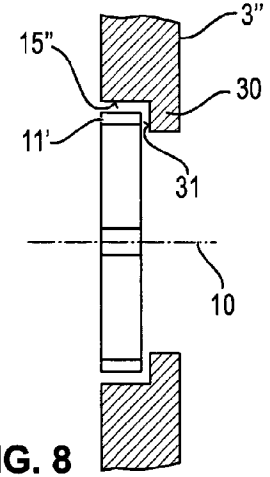
FIG. 8 is a longitudinal sectional view through the assembly from FIG. 7.

FIG. 8 shows a section through the assembly from FIG. 7 along an axis 20. It can be seen there that the gap between the peripheral surface 15" and the fan wheel ring 11' runs in a labyrinth-like manner partly in an axial, partly in a radial, direction. This is achieved by a stop-like shoulder 30 in the profile of the fan frame 3". The shoulder 30 projects radially inwards and forms a face 31 against which the fan wheel ring 11 bears in a contact-free manner in an axial direction 10 perpendicular to the tilting plane.

Figure 9:
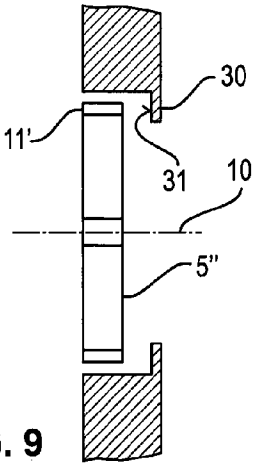
FIG. 9 is a further longitudinal sectional view through the assembly from FIG. 7.

A longitudinal section through the assembly in FIG. 7 along the axis 19 is shown in FIG. 9 and it can be seen there that in the region of an upper and lower circumferential portion, again indicated by dotted lines in FIG. 7, the shoulder 30 is of a thinner design in the axial direction 10 than in the remaining circumferential portions of the periphery of the opening 4'", which means that a gap between the fan wheel ring 11' and the face 31 that is greater in the axial direction 10 is produced in these regions.

Another way of viewing the three-dimensional shape of the stop 30 can be formulated such that in the regions in which parts of the shoulder 30 within the separate circumferential portions are left out or removed, the radius of the peripheral face 15" of the opening 4" is enlarged.

The use of the assembly according to FIGS. 7, 8 and 9 is conceivable in principle, such that the radially inwardly projecting step of the peripheral face can be placed upstream or downstream of the fan wheel in the airflow, in other words, the airflow may optionally be provided from left to right, but also from right to left, in FIGS. 8 and 9.

Figure 11:
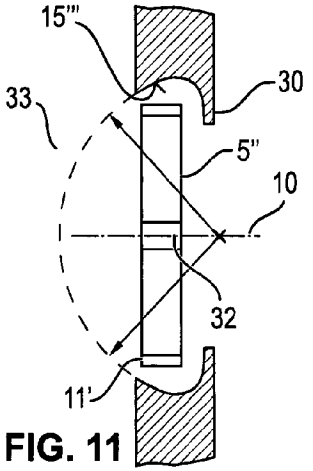
FIG. 11 is a further longitudinal sectional view through the same assembly, as shown in FIG. 10.
Figure 10:
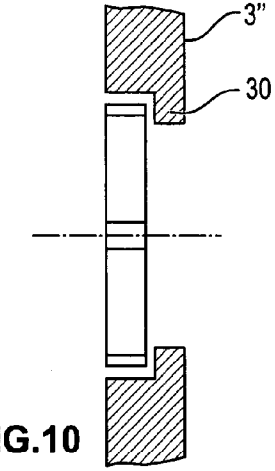
FIG. 10 is a longitudinal sectional view through a further fan assembly.

Two different longitudinal sections of a modified ventilation device are shown in FIGS. 10 and 11, wherein FIG. 10 shows the section in the region of the circumferential portions which are substantially cylinder-symmetrical, in other words not radially extended, while FIG. 11 presents a longitudinal section in a plane in which the two separate circumferential portions diametrically opposite one another are located, in which the continuous opening is radially extended and the axial gap between the fan wheel 5" and the periphery 15'" of the opening is enlarged.

FIG. 10 shows a configuration resembling the one shown in FIG. 8. In particular, the shape of the peripheral face of the opening according to FIG. 10 therefore looks similar in the region of the non-radially extended circumferential portions to how it does in the ventilation device according to FIG. 7.

In the circumferential portions referred to by way of example as 17', 18' in FIG. 7 and in which a radially extended contour of the peripheral face 15'" of the opening 4'" is present, this is on the one hand achieved in that the shoulder 30 of the fan frame 3" is made smaller in the axial direction of the axis 10 and that to this extent the radius is made larger compared with the remaining circumferential portions on part of the peripheral face 15''' in the separate circumferential portions.

In addition, however, it can be seen in FIG. 11 that the contour of the peripheral face 15''' is concave in shape, in other words rounded, such that a pitching movement of the fan wheel 5'' along the peripheral face 15''' is made possible. In the exemplary embodiment shown, the concave peripheral face 15''' is formed such that it corresponds to portions of a spherical surface about the center point of the sphere 32, wherein the center point of the sphere 32 corresponds to the point of intersection of a center axis 10 with a pitching axis of the fan wheel 5'' standing perpendicular to the drawing plane. A yawing movement during tilting of the fan wheel in a tilting plane perpendicular to the drawing plane, wherein the tilting plane contains the center axis 10, has a tendency to tilt the fan wheel within the drawing plane about the axis standing perpendicularly to the drawing plane through the center point of the sphere 32. The continued contour of the spherical surface is shown by a dotted line and labeled 33. The corresponding concave embodiment of the peripheral face 15''' therefore allows the fan wheel ring 11' to remain at a uniformly small distance from the peripheral face 15''' of the opening in the fan frame during a yawing movement. The size of the axial gap between the fan wheel ring and the periphery of the opening therefore changes only minimally during a pitching movement. A small axial gap can therefore be selected with the configuration overall.

The shaping of the peripheral face 15''' in the form of a spherical surface portion may, in principle, also be provided over the entire circumference of the opening.

The invention described allows in its different embodiments the provision of a small axial gap between a fan wheel and the periphery of the opening in a fan frame, without there being any fear of contact between the fan wheel and the periphery of the opening when there is a tilting movement of the ventilation device due to yawing/spinning moments.

The use of the assembly according to FIGS. 10 and 11 is also conceivable in principle, such that the radially inwardly projecting step of the peripheral face in the airflow can be placed upstream or downstream of the fan wheel, in other words, the airflow may be optionally provided from left to right, but also from right to left, in FIGS. 10 and 11.

Figure 12:
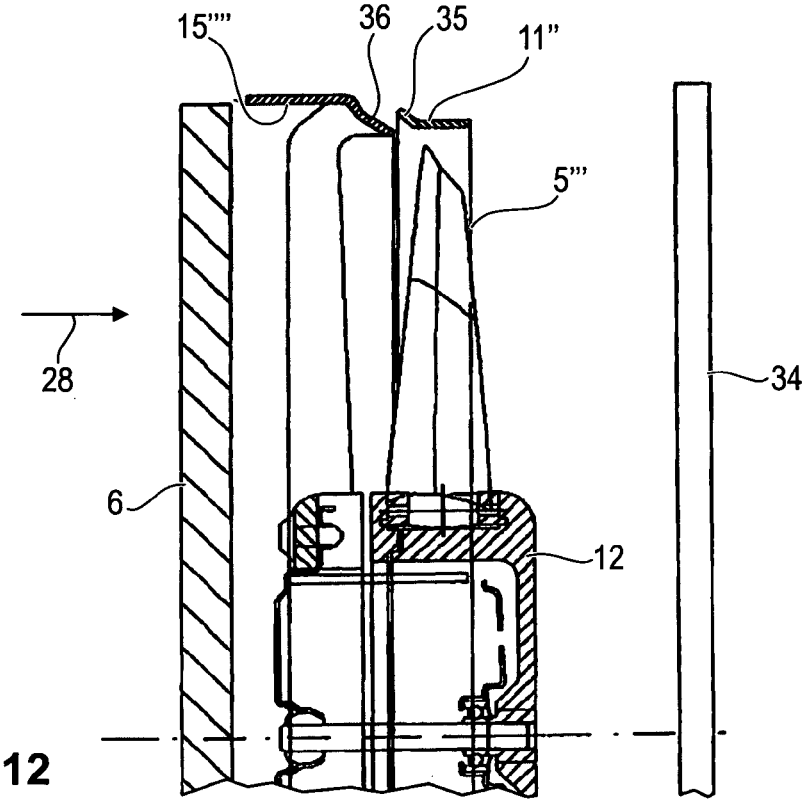
FIG. 12 is a longitudinal sectional view through a fan with special gap geometry.

FIG. 12 shows in longitudinal section a cooler 6 through which air flows in the direction shown by the arrow 28. The airflow is produced at least partly by a fan wheel 5''' driven by a motor 12. A baffle plate 34 is disposed behind the fan wheel 5'''. The fan wheel has a fan wheel ring 11'' with a lip 35 extending obliquely radially outwards, which lip is roughly in the shape of a complementary lip 36 in the peripheral face 15''''. The lip 36 is axially offset from the fan wheel 5''' in the two separate circumferential portions.

Figure 13:
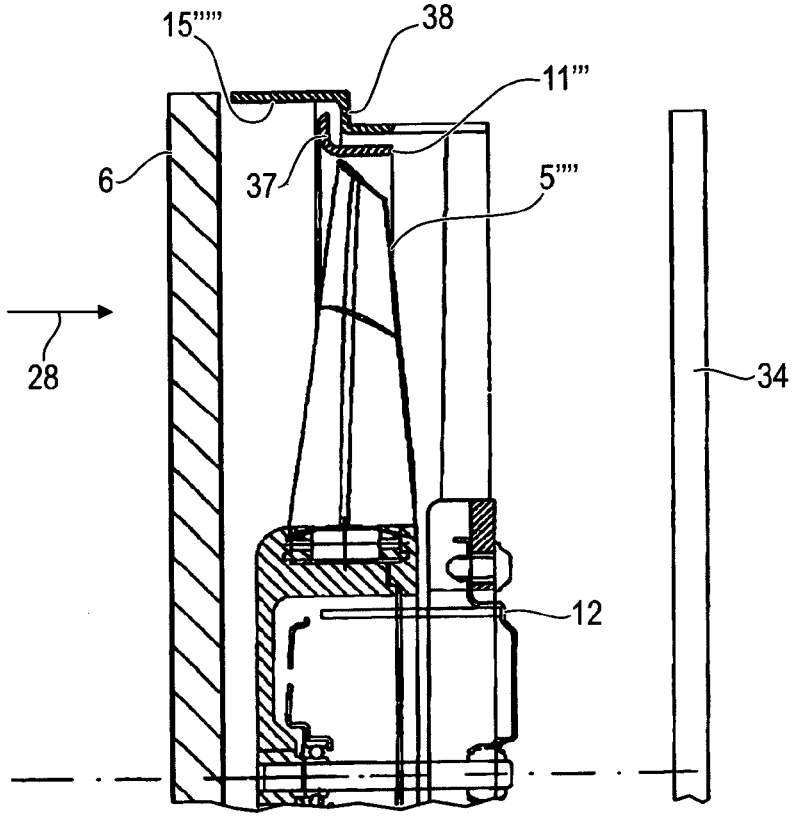
FIG. 13 is a longitudinal sectional view through a fan with another special gap geometry.

FIG. 13 shows in a longitudinal section a cooler 6 upstream of a fan wheel 5''''. The fan wheel ring 11''' of the fan 5'''' has a lip 37 which lies opposite a step 38 in the peripheral face 15'''''. The step 38 is offset away from the lip 37 of the fan wheel ring 11''' in the two separate circumferential portions axially in the direction of the arrow 28, which also denotes the direction of the airflow.

FIGS. 14, 15, 16 and 17 each show in longitudinal section a fan wheel ring 39, 39', 39'', 39''' and a peripheral face 40, 40', 40'', 40''' of an opening in a fan frame or holder of a fan.

Figure 14:
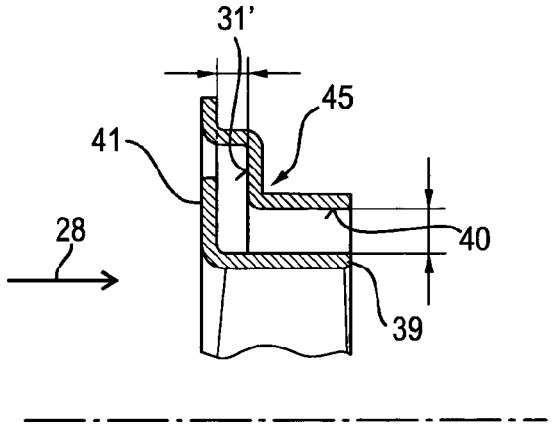
FIGS. 14-17 are illustrations of further different embodiments of the gap between the fan wheel and peripheral face in longitudinal section in each case.

FIG. 14 shows a fan wheel ring 39 with a lip 41 projecting outwards radially perpendicularly to the axial direction, which lip lies opposite a seal surface 31' on a step 45 of the peripheral face 40 forming a gap. The step 45 is axially offset from the lip 41 in the direction of the arrow 28 denoting the flow direction in the two separate circumferential portions.

Figure 15:
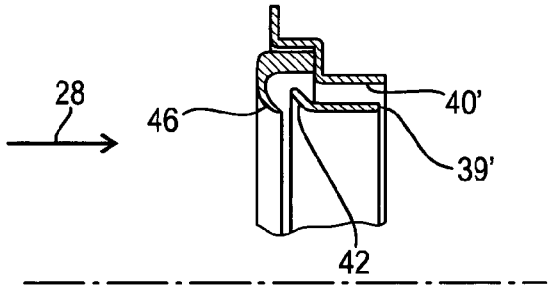

FIG. 15 shows a fan wheel ring 39' with an obliquely outwardly projecting lip 42 which lies opposite a radially inwardly projecting lip 46 which is hook-shaped in cross section of the peripheral face 40' forming a gap. The lip 46 in the two separate circumferential portions is axially offset from the fan wheel ring 39' against the direction indicated by the arrow 28.

Figure 16:
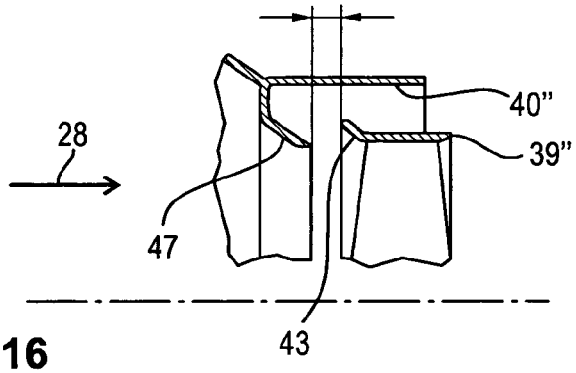

FIG. 16 depicts a fan wheel ring 39'' with a radially obliquely outwardly pointing lip 43. The lip lies opposite a radially outwardly projecting lip 47 which is hook-shaped in cross section of the peripheral face 40'' forming a gap.

The lip 47 is axially offset from the fan wheel ring 39'' against the direction indicated by the arrow 28 in the two separate circumferential portions.

Figure 17:
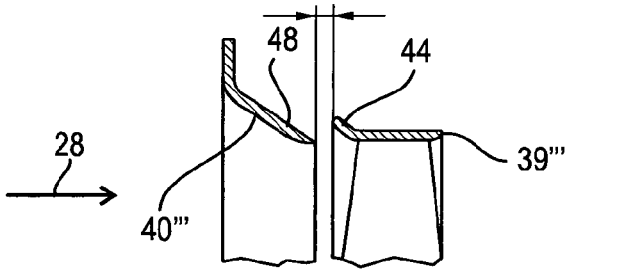

FIG. 17 shows a fan wheel ring 39''' with a radially obliquely outwardly pointing lip 44. The lip lies opposite the lip 48 which is part of the peripheral face 40''' and points obliquely radially inwards. The lip 48 is offset axially from the fan wheel ring 39''' against the arrow 28 in the two separate circumferential portions.

Figure 18:
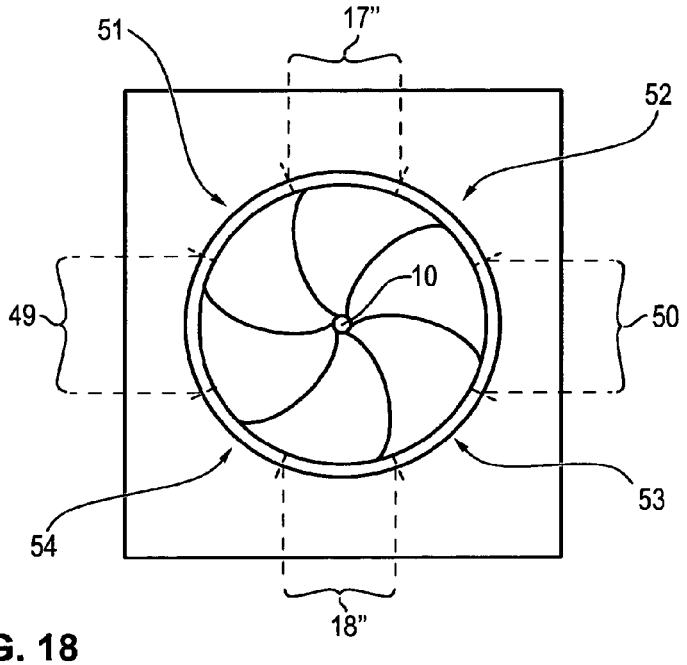
FIG. 18 is a front view of a further ventilation device.

FIG. 18 shows a front view of a ventilation device with a fan frame 3''' in which two separate circumferential portions 17'' and 18'' which are opposite one another are drawn in at the top and bottom. On the circumferential portions, a radially inwardly projecting projection of the peripheral face is offset in an axial direction from the space provided for the fan wheel in such a manner that the gap in this case is 12.5 mm in an axial direction between the projection and the fan wheel at standstill, while the comparable gap in the circumferential portions 49, 50 lying in the horizontal is only 9.5 mm in the axial direction offset by 90° in respect of the circumferential portions 17'', 18''. In the circumferential regions 51, 52, 53, 54 lying between the circumferential regions 17'', 49, 18'' and 50, a transition in the gap dimension is provided, particularly a stepless transition.

Figure 19:
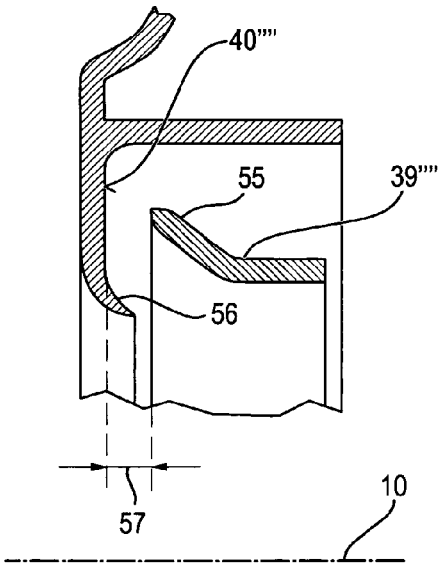
FIGS. 19 and 20 are illustrations showing two partial sections from FIG. 18.
Figure 20:
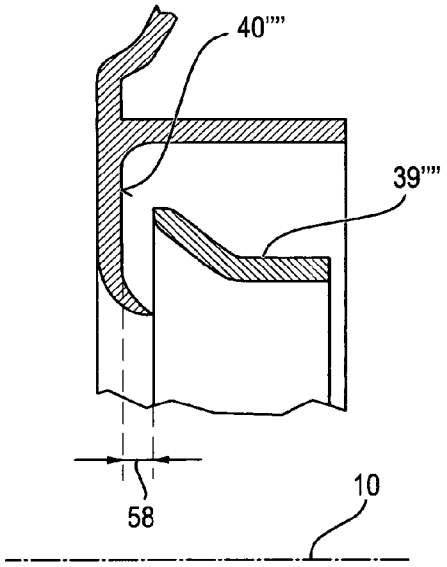

FIG. 19 shows a section through part of an assembly according to FIG. 18 in the region 17'', wherein 10 is used to denote a central and rotational axis, 39'''' a fan wheel ring and 40''' the corresponding peripheral face on the fan frame. In the case of FIG. 18, i.e. in the case of the section in the region 17'' in FIG. 18, the gap 57 in the axial direction is 12.5 mm and the gap 58 in the case of FIG. 20, i.e. in the circumferential regions 49, 50, where the section depicted in FIG. 20 is located, is 9.5 mm. The fan ring 39'''' in this case has a chamfer or else a conically extending region on its circumferential edge 55 facing the peripheral face 40'''', while the periphery of the frame opening exhibits a cone 56 which runs radially within the fan wheel ring 39'''' in an axial direction on the fan wheel ring. The conical periphery 55 of the fan ring 39'''' and the cone 56 of the periphery of the frame opening may have substantially the same cone angle and common parts of a labyrinth seal.

The following is a summary list of reference numerals and the corresponding structure used in the above description of the invention:

1 Cooler housing
2 Frame
3,3',3'' Fan frame
4,4',4'',4''' Opening
5,5',5'',5''',5'''' Fan wheel
6 Cooler
7 Hub
8,8',9,9' Conveying blades
10 Center axis

11,11',11",11'" fan wheel ring
12 Motor
13,14 Strut
15,15',15",15'",15"",15'"" Peripheral surface of the opening 4
16 Shaft
17,17',17",18,18',18" Separate circumferential portions
19 Axis
20 Axis
21 Fixing point of the pitching movement
22,23,24 Double arrow
25 Axial gap
26 Motor vehicle
27 Direction of travel
28 Airflow direction
29 Double arrow
30 Shoulder, step
31,31' Seal surface
32 Pivot point, center point of the sphere
33 Circular arc
34 Baffle plate
35 Lip of the fan wheel ring
36 Lip of the peripheral face 15""
37 Step in the peripheral face 15""
38 Step in the peripheral face 15'""
39,39',39",39'",39"" Fan wheel ring
40,40',40",40'",40"" Peripheral face
41 Lip of 39
42 Lip of 39'
43 Lip of 39"
44 Lip of 39'"
45 Step of 40
46 Lip of 40'
47 Lip of 40"
48 Lip of 40'
49,50 Circumferential regions
51,52,53,54 Circumferential regions
55 Periphery of 39""
56 Cone of 40""
57 Gap
58 Gap

The invention claimed is:

1. A ventilation device, comprising:

a fan wheel;

a holder having a substantially circular continuous opening formed therein for receiving said fan wheel rotating about a center axis of said opening, said holder having a peripheral face and said opening being bordered by said peripheral face running substantially cylinder-symmetrically about said center axis; and said peripheral face having two separate circumferential portions diametrically opposite one another and remaining circumferential portions between said separate circumferential portions; and a circumferential projection projecting from said peripheral face radially inwards and being axially offset from said fan wheel, said circumferential projection being spaced from said fan wheel at a greater axial distance in said separate circumferential portions than in said remaining circumferential portions.

2. The ventilation device according to claim 1, wherein:

said peripheral face extends in a circumferential direction and in an axial direction of said center axis of said opening; and said radius of said peripheral face in said two separate circumferential portions is enlarged at least on a partial face of a part of said peripheral face which extends in the axial direction, in comparison with the cylinder-symmetrical form in said remaining circumferential portions.

3. The ventilation device according to claim 1, wherein said peripheral face in a longitudinal section has a step or a lip running in a radial direction in respect of said center axis, said step or said lip forms a sealing surface for a radial outer region of said fan wheel, and said step or said lip is offset in an axial direction in said two separate circumferential portions diametrically opposite one another in comparison with said remaining circumferential portions, in order to increase the space for receiving said fan wheel.

4. The ventilation device according to claim 3, wherein an axial offset of said step or said lip in said separate circumferential portions in a circumferential direction is variable in steps or continuously and reaches a maximum in each case in a center of said separate circumferential portions.

5. The ventilation device according to claim 1, wherein said peripheral face is concavely curved in said two separate circumferential portions diametrically opposite one another in a longitudinal section.

6. The ventilation device according to claim 5, wherein said circumferential portions of said peripheral face which are of concave design in a longitudinal section form part of a spherical face which has a spherical center point within said opening, said spherical center point within said opening is on said center axis.

7. The ventilation device according to claim 1, wherein said holder is a fan frame.

8. A ventilation device, comprising:

a fan wheel;

a holder having a substantially circular continuous opening formed therein for receiving said fan wheel rotating about a center axis of said opening, said holder having a peripheral face and said opening being bordered by said peripheral face running substantially cylinder-symmetrically about said center axis; and said peripheral face having two separate circumferential portions diametrically opposite one another with a radius being at least partly enlarged in comparison with a cylinder-symmetrical form in remaining circumferential portions of said peripheral face;

said peripheral face being concavely curved in said two separate circumferential portions diametrically opposite one another in a longitudinal section, said circumferential portions of said peripheral face which are of concave design in a longitudinal section forming part of a spherical face having a spherical center point within said opening.

9. A vehicle, comprising:

a ventilation device having a fan wheel and a holder for said fan wheel, said holder having a substantially circular continuous opening formed therein with said fan wheel rotating about a center axis of said continuous opening, said holder having a peripheral face bordering said continuous opening, said peripheral face running substantially cylinder-symmetrically about said center axis, and formed between a circumferential contour of said fan wheel and said peripheral face is a gap;

said peripheral face having two separate circumferential portions diametrically opposite one another and remaining circumferential portions between said separate circumferential portions;

a circumferential projection projecting from said peripheral face radially inwards and being axially offset from said fan wheel, said circumferential projection being spaced from said fan wheel at a greater axial distance in said separate circumferential portions than in said remaining circumferential portions; and an installation position of said ventilation device in the vehicle being such that said center axis is substantially oriented in a straightforward driving direction of the vehicle, said separate circumferential portions being disposed in an uppermost region of said peripheral face and in a lowermost region of said peripheral face.

* * * * *